US008991815B2

(12) United States Patent
Toya et al.

(10) Patent No.: US 8,991,815 B2
(45) Date of Patent: Mar. 31, 2015

(54) SEPARATING AND TAKING OUT DEVICE AND SEPARATING AND TAKING OUT METHOD

(71) Applicant: Kabushiki Kaisha Toshiba, Minato-ku, Tokyo (JP)

(72) Inventors: Kiminori Toya, Kanagawa-ken (JP); Yuji Kubota, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/203,908

(22) Filed: Mar. 11, 2014

(65) Prior Publication Data

US 2014/0353906 A1 Dec. 4, 2014

(30) Foreign Application Priority Data

May 30, 2013 (JP) ..... 2013-114160

(51) Int. Cl.

| | |
|---|---|
| ***B65H 3/62*** | (2006.01) |
| ***B65H 3/00*** | (2006.01) |
| ***B65H 1/04*** | (2006.01) |
| ***B65H 5/00*** | (2006.01) |

(52) U.S. Cl.

CPC .. *B65H 3/00* (2013.01); *B65H 1/04* (2013.01); *B65H 5/008* (2013.01)

USPC ..... 271/146; 271/90; 271/97

(58) Field of Classification Search

CPC ..... B65H 3/62; B65H 1/025; B65H 1/24; B65H 7/02; B65H 31/40

USPC ..... 271/90, 97, 145, 146

See application file for complete search history.

(56) References Cited

U.S. PATENT DOCUMENTS

| | | | | |
|---|---|---|---|---|
| 7,172,116 | B2 * | 2/2007 | Yamamiya | 235/381 |
| 7,249,762 | B1 * | 7/2007 | Bakker et al. | 271/146 |
| 7,694,957 | B2 | 4/2010 | Nukada et al. | |
| 7,708,268 | B2 | 5/2010 | Toya et al. | |

FOREIGN PATENT DOCUMENTS

| | | | | |
|---|---|---|---|---|
| JP | 01110443 A | * | 4/1989 | B65H 3/62 |
| JP | 2007-145567 | | 6/2007 | |

* cited by examiner

*Primary Examiner* — Prasad Gokhale

(74) *Attorney, Agent, or Firm* — Amin, Turocy & Watson, LLP

(57) ABSTRACT

In one embodiment, a separating and taking out device has a feeding base, a takeout part, a support part and an ultrasonic vibrator. The feeding base places a piled stack. The piled stack is composed of a plurality of media stacked in a direction. The taking out part takes out the plurality of media one by one from one end in the direction of the piled stack. The support part has a facing surface opposing a side surface of the piled stack. The ultrasonic vibrator has a vibrating surface opposing the end in the direction of the piled stack and one end in the direction of the support part. The ultrasonic vibrator oscillates the vibrating surface along a line connecting the vibrating surface with a gap between the side surface of the piled stack and the facing surface of the support part.

10 Claims, 9 Drawing Sheets

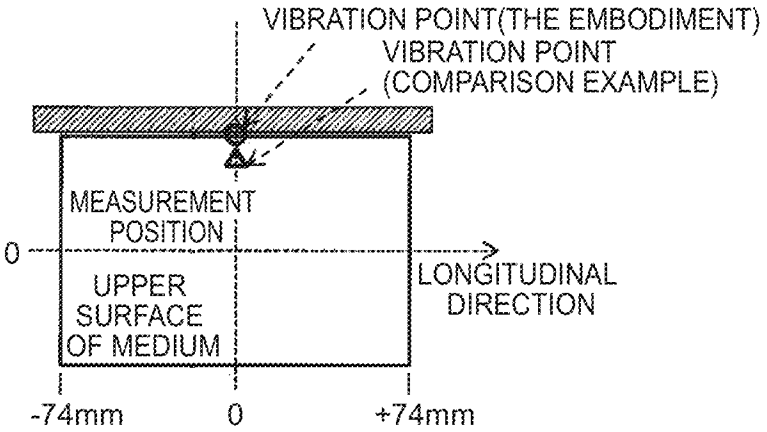
FIG. 5A
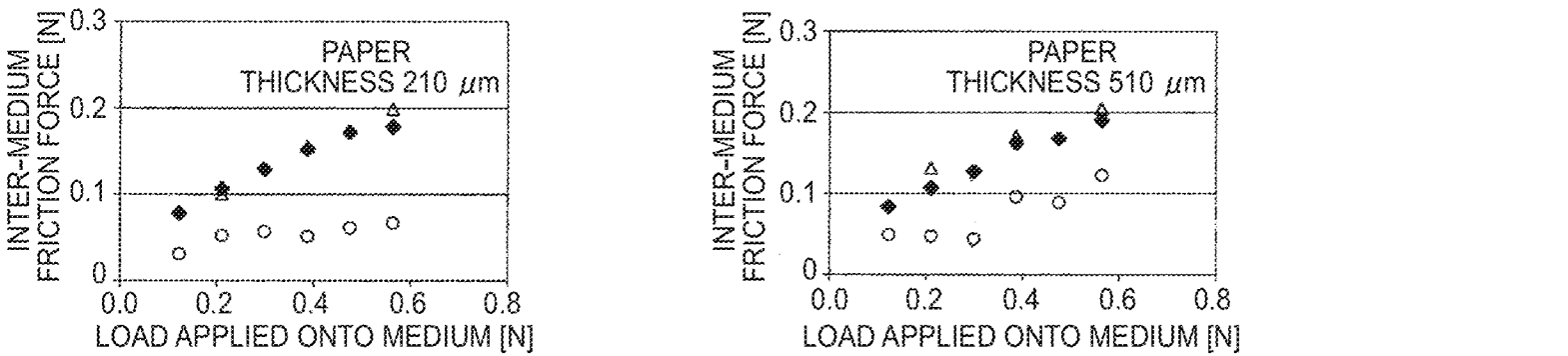
FIG. 5B
FIG. 5C

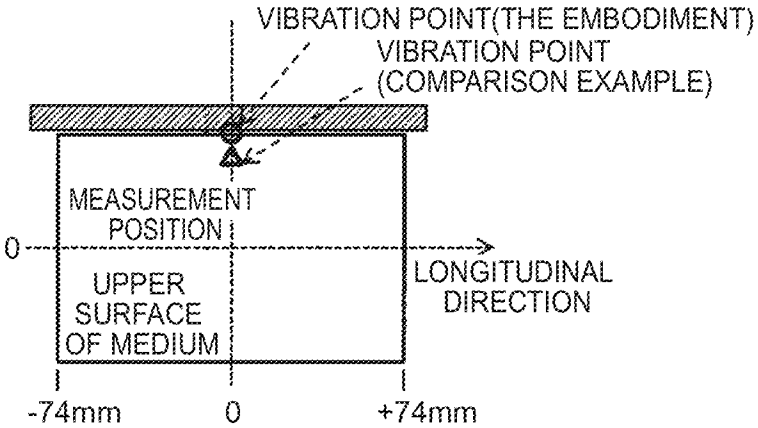
FIG. 7A
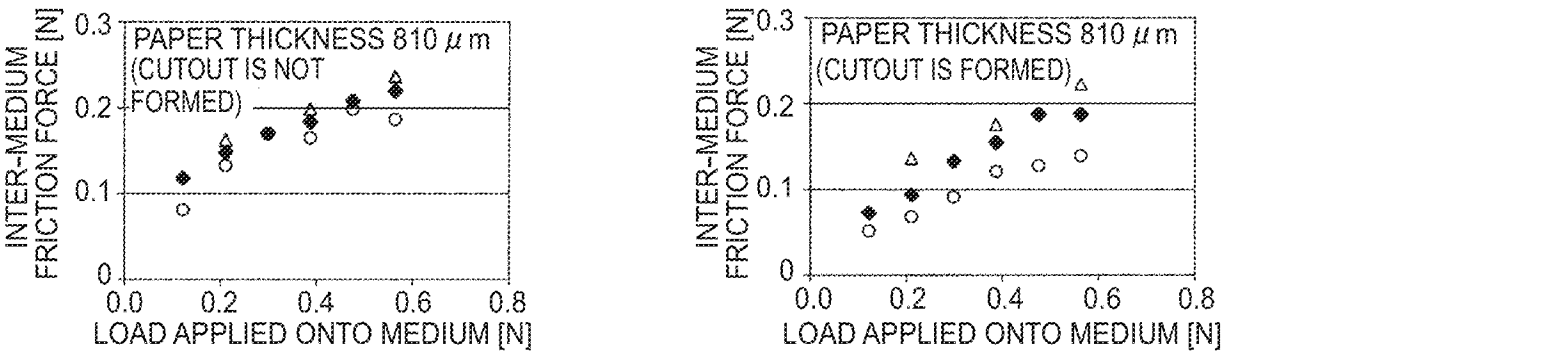
FIG. 7B
FIG. 7C

SEPARATING AND TAKING OUT DEVICE AND SEPARATING AND TAKING OUT METHOD

CROSS-REFERENCE TO RELATED APPLICATION

This application is based upon and claims the benefit of priority from the prior Japanese Patent Application No. 2013-114160, filed on May 30, 2013, the entire contents of which are incorporated herein by reference.

FIELD

Embodiments described herein relate generally to a separating and taking out device and a separating and taking out method.

BACKGROUND

A separating and taking out device is used in equipment such as printers, copying machines, automatic teller machines (ATMs) and mail article processors. The separating and taking out device separates stacked media such as paper sheets one by one from a piled stack composed of the stacked media. The separating and taking out device is required to have performance to separate media one by one reliably. In some cases, such a separating and taking out device can not separate media certainly, due to meshed concave and convex shapes on surfaces of media or an electrostatic attraction force, for example. Accordingly, a technique of reducing friction force between stacked media by oscillating an ultrasonic vibrator in the vicinity of surfaces of stacked media is proposed.

However, in some cases, it is difficult depending on a type of media to reducing friction force between stacked media sufficiently and to separate media one by one reliably.

BRIEF DESCRIPTION OF THE DRAWINGS

FIGS. 5A to 5C are views illustrating measurement results of a friction force of the separating and taking out device according to the first embodiment.

FIGS. 7A to 7C are views for explaining measurement results of a friction force of the separating and taking out device according to the second embodiment.

DETAILED DESCRIPTION

Figure 1:
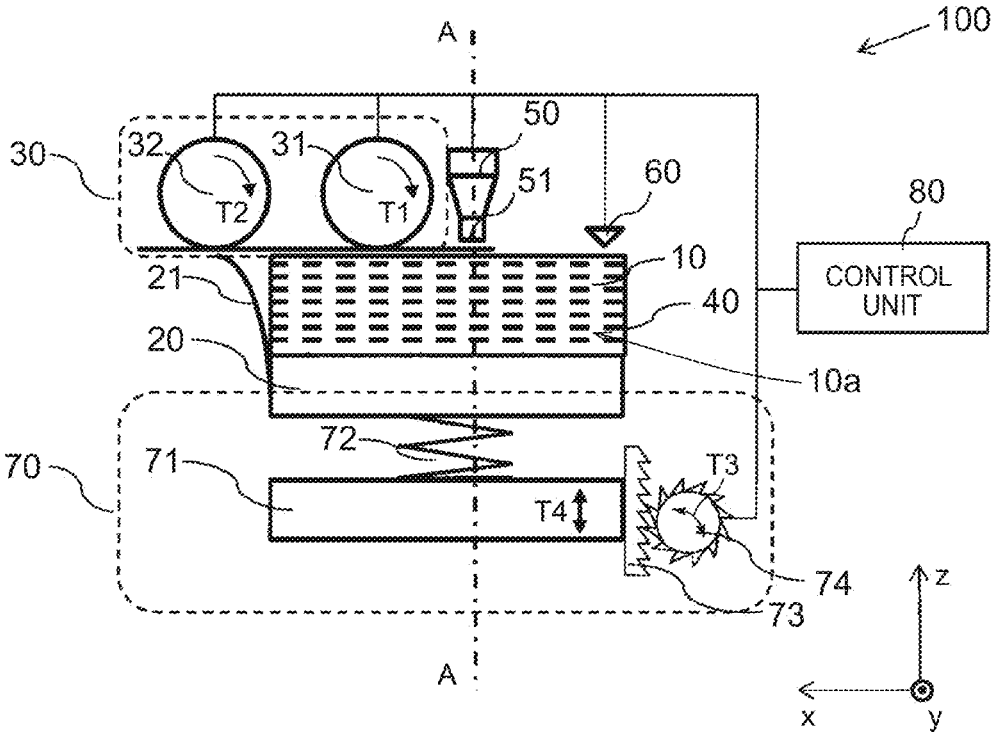
FIG. 1 is a configuration diagram schematically illustrating a separating and taking out device according to a first embodiment.

According to one embodiment, a separating and taking out device is provided. The separating and taking out device has a feeding base, a takeout part, a support part and an ultrasonic vibrator. The feeding base places a piled stack. The piled stack is composed of a plurality of media stacked in a direction. The taking out part takes out the plurality of media one by one from one end in the direction of the piled stack. The support part has a facing surface opposing a side surface of the piled stack. The ultrasonic vibrator has a vibrating surface opposing the end in the direction of the piled stack and one end in the direction of the support part. The ultrasonic vibrator oscillates the vibrating surface along a line connecting the vibrating surface with a gap between the side surface of the piled stack and the facing surface of the support part.

Hereinafter, further embodiments will be described with reference to the drawings. In the drawings, the same reference numerals denote the same or similar portions respectively.

A first embodiment will be described with reference to FIG. 1 and FIG. 2.

FIG. 1 is an configuration diagram schematically illustrating a separating and taking out device according to a first embodiment. FIG. 2 is a cross-sectional view taken along A-A of the separating and taking out device of FIG. 1.

A separating and taking out device 100 is used in printers, copying machines, automatic teller machines (ATMs), mail particle processors etc. The separating and taking out device 100 separates and takes out sheet media such as printing paper, bills, copy paper, postcards, envelopes or securities one by one.

The separating and taking out device 100 is suitable to separate and take out media of low permeability in particular. The media of low permeability are coating paper, media made of plastic or metal etc. Permeability of media is expressed by a numerical value as air permeability of the JIS Standards (JIS P 8117), for example.

Specifically, the air permeability is represented by a time necessary to transmit air of 100 ml through a medium having an area of 645 $mm^2$ under a pressure of 20.6 kPa. Air permeability of normal postal cards is about 60 seconds. The separating and taking out device 100 is also applicable to media of low permeability having air permeability larger than 60 seconds. The function of the separating and taking out device 100 to separate and take out media having permeability is enhanced compared to a conventional technique.

The separating and taking out device 100 of FIG. 1 has a sheet feeding base 20, a separating and taking out portion 30, a support part 40 and an ultrasonic vibrator 50. Media 10 are stacked in one direction (z axis direction) on the sheet feeding base 20, and forms a piled stack 10*a* placed on the sheet feeding base 20. The separating and taking out portion 30 separates and takes out the media 10 in a takeout direction (x axis direction) from one end (an upper end) of the piled stack 10*a* of the media 10 in the z axis direction. The support part 40 contacts with at least a portion of side surfaces of the media 10 parallel to the z axis direction (side surfaces parallel or vertical to the x axis direction). The ultrasonic vibrator 50 has a vibration surface 51 which opposes to a portion of a surface of one of the stacked media 10 on an uppermost surface side and to a portion of the support part 40.

Further, the separating and taking out device 100 has a measuring unit 60, a moving unit 70 and a control unit 80. The measuring unit 60 measures one position of the one of the stacked media 10 on an uppermost surface side. A well-known medium conveying mechanism can be used for the moving unit 70. The moving unit 70 has a moving base 71, an elastic structure 72, a rack 73 and a pinion 74. The moving base 71 supports the sheet feeding base 20 in the z axis direction through the elastic structure 72. The control unit 80 controls operations of the separating and taking out portion 30, the ultrasonic vibrator 50, the measuring unit 60 and the moving unit 70.

The piled stack 10*a* of the media 10 is set on the sheet feeding base 20 as described above. The separating and taking out device 100 separates and takes out the media 10 from an upper end portion of the piled stack 10*a* set on the sheet feeding base 20, one by one. One surface of the one of the stacked media 10, which is positioned at an uppermost end portion of the piled stack 10*a* and is processed first, is a top surface of the piled stack 10*a*. The opposite surface of the one of the piled stack 10*a* which opposes to the top surface is a bottom surface. Four surfaces other than the top surface and the bottom surface are side surfaces.

The sheet feeding base 20 has a guide plate 21 which forms a conveying path of the media 10 between the sheet feeding base 20 and a convey roller 32 in the takeout direction (x axis direction).

The separating and taking out portion 30 has a takeout roller 31 and the convey roller 32. The takeout roller 31 is arranged to contact with the top surface of the piled stack 10*a* of the media 10. When the takeout roller 31 rotates in a direction of an arrow T1, one of the media 10 on the uppermost surface side which contacts with the takeout roller 31 is conveyed in the takeout direction (x direction), and is taken out from the piled stack 10*a*.

Further, the convey roller 32 is arranged in a downstream from the takeout roller 31 in the takeout direction (x axis direction). When the convey roller 32 rotates in a direction of an arrow T2, each media 10 which is taken out by the takeout roller 31 is further conveyed in the x direction in the convey path between the convey roller 32 and the guide plate 21 of the sheet feeding base 20.

Figure 2:
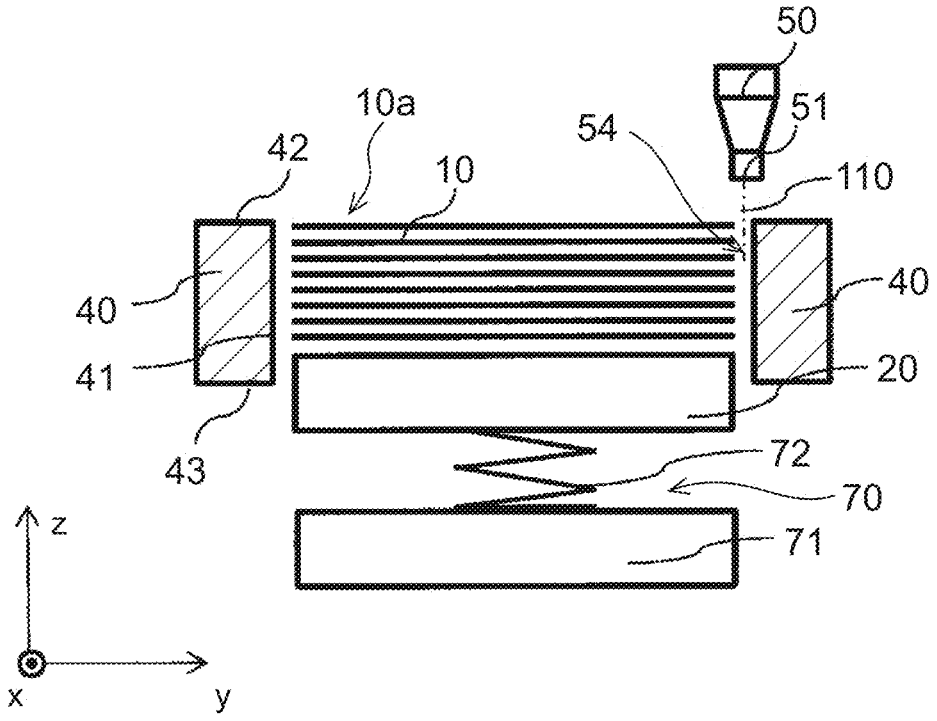
FIG. 2 is a cross-sectional view taken along A-A of the separating and taking out device of FIG. 1.

As illustrated in FIG. 2, the support part 40 has a facing surface or contact surface 41 which opposes to or contacts a side surface of the piled stack 10*a* of the media 10, and a top surface 42 which is nearly parallel to the top surface of the piled stack 10*a*. In the present embodiment, the support part 40 contacts with a portion of the side surface of the piled stack of the media 10 which is vertical to the y axis direction orthogonal to the z axis direction and the x axis direction.

The support part 40 contacts with the portion of the side surface of the piled stack 10*a* so that it is possible to align the side surfaces of the media 10 of the piled stack 10*a*. A material of high rigidity such as metal can be used for the support part 40, for example.

As illustrated in FIG. 2, the ultrasonic vibrator 50 is a vibrator which oscillates the vibration surface 51 to supply compressed air along a line 110 which connects the vibration surface 51 with a gap 54 between the side surface of the piled stack 10*a* of the media 10 and the contact surface 41 of the support part 40. For the vibrator, those which oscillate at a specific frequency of an object such as a bolting Langevin type transducer or a bimorph Type transducer can be used. An ultrasonic wave is within a range of an acoustic wave which is inaudible to people depending on individual differences of people who handle devices, for example, within an acoustic range of 20 kHz or more. The vibration surface 51 may not have a circular shape and desirably has a rotationally symmetrical shape. The line 110 desirably passes through the center or the gravity center of the vibration surface 51 of the ultrasonic vibrator 50, is vertical to the vibration surface 51 and is vertical to the top surface of the piled stack 10*a*, i.e., parallel to the z axis.

The vibration surface 51 of the ultrasonic vibrator 50 opposes to the top surface of the piled stack 10*a* of the media 10 and the top surface 42 of the support part 40. When the opposing area of the vibration surface 51 and the top surface of the piled stack 10*a* is $S_1$ and an opposing area of the vibration surface 51 and the top surface 42 of the support part 40 is $S_2$, the area rate $S_1$:$S_2$ is desirably 1:1. The opposing areas are obtained by projection in the z axis direction. According to the setting, when the line 110 passes through the center of the vibration surface 51 and is vertical to the vibration surface 51, the center of the vibration surface 51 at which a pressure of compressed air of an ultrasonic wave is the highest directly below the vibration surface 51 opposes to the gap 54 between the side surface of the piled stack 10*a* of the media 10 and the contact surface 41 of the support part 40. As a result, it is possible to efficiently supply air to the gap 54.

Figure 3:
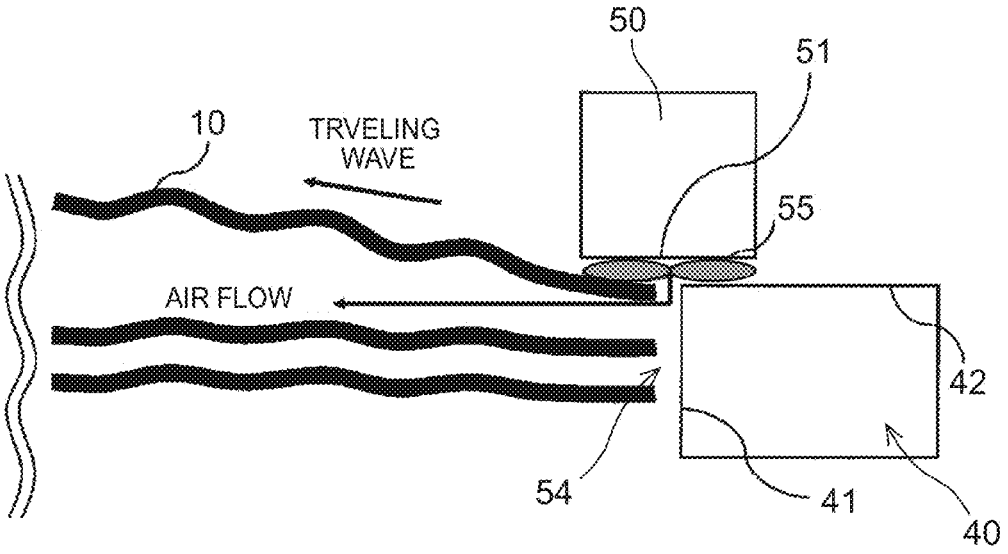
FIG. 3 is a conceptual diagram illustrating a flow of air according to the first embodiment.

FIG. 3 is a conceptual diagram illustrating an air flow according to the present embodiment. When the vibration surface 51 of the ultrasonic vibrator 50 oscillates at a vibration point, compressed air 55 is produced between the vibration surface 51 and both of the top surface of the piled stack of the media 10 and the top surface 42 of the support part 40, by an acoustic radiation pressure. The compressed air flows in the gap 54 between the side surface of the piled stack of the media 10 and the contact surface 41 of the support part 40 due to a pressure difference, and flows in between the stacked media 10 from the gap 54. In this case, simultaneously, when the vibration surface 51 of the ultrasonic vibrator 50 oscillates at a vibration point, a traveling wave is produced. The traveling wave spreads from the vibration point above the top surface of the piled stack of the media 10 along the xy plane in FIG. 2. The traveling wave causes the air which flows in between one of the media 10 on an uppermost end side and another one of the media 10 on a second uppermost surface side to spread along the xy plane from a vibration point. Thus, it is possible to float the media 10 and to reduce a friction force between the media 10 by a hydrostatic bearing effect. In particular, it is possible to reduce the friction force between the one of the media 10 on the uppermost end side and the other one of the media 10 on the second uppermost surface side much. As a result, it is possible to separate and take out the media 10 one by one from the piled stack, more reliably.

The embodiment and a comparative example will be compared. According to the comparative example, when a vibration surface is oscillated by opposing the vibration surface of an ultrasonic vibrator entirely to a top surface of a piled stack of media, compressed air is produced between the vibration surface and the piled stack of the media by an acoustic radiation pressure. A friction force between stacked media is reduced to some degree by a hydrostatic bearing effect caused when this compressed air transmits through the media.

However, when air permeability of the media is low, the amount of compressed air which transmits through one of the media to be separated is small or the compressed air does not transmit at all, and a sufficient hydrostatic bearing effect is not produced and the friction force between the stacked media is not reduced sufficiently.

According to the embodiment, even when air permeability of media is low, air can flow between the stacked media 10 through the gap between the side surface of the piled stack of the media and the contact surface 41 of the support part 40, so that it is possible to reduce the friction force between the stacked media 10 sufficiently.

Figure 4B:
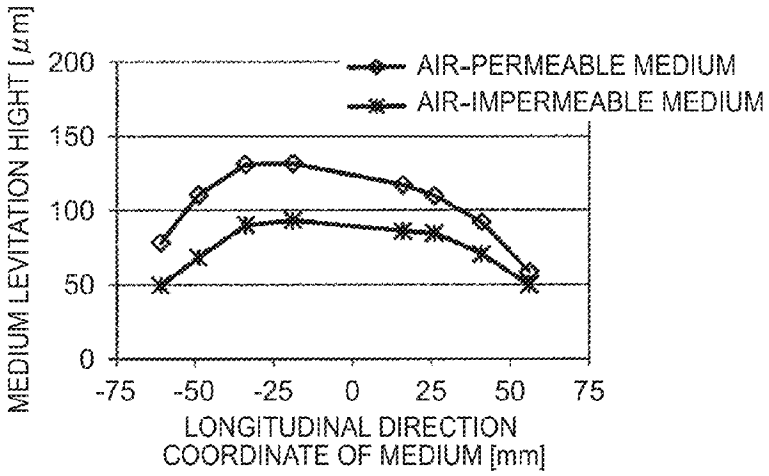
FIGS. 4A and 4B are views for explaining a measurement result of a levitation height of a medium.
Figure 4A:
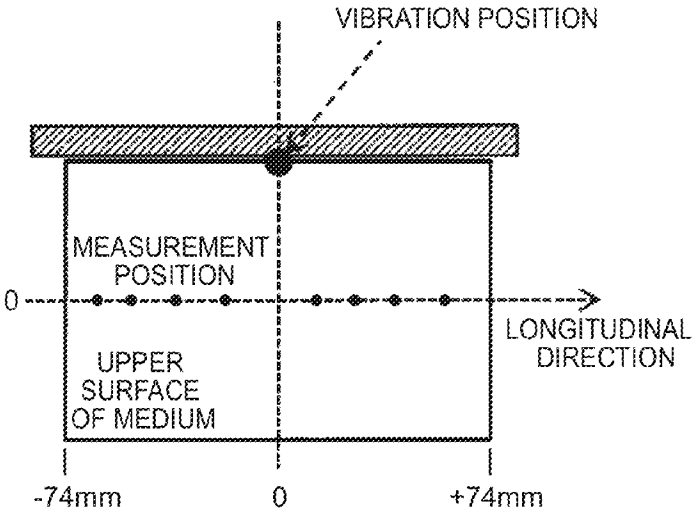

FIGS. 4A and 4B are views for explaining results obtained by measuring levitation heights using the device according to the embodiment. Sheets of thick paper were used for media in the measurement. FIG. 4A indicates a measurement position. Levitation heights of the sheets of thick paper shown in FIG. 4A were measured at eight points which were located along a longitudinal direction in paper surfaces of the sheets of thick paper. FIG. 4B shows distributions of measured levitation heights. One group of the sheets of thick paper (media) had a size of a postcard and had permeability. Another one group of the sheets of thick paper (media) had a size of a postcard and did not have permeability at vibration points of the sheets of thick paper because tapes were pasted on the vibration points of the sheets of thick paper. In a case that sheets of thick paper which do not have permeability are used, if one of the sheets of thick paper on an uppermost end side floats, it means that air flows in between the one of the sheets of thick paper on the uppermost end side and another one of the sheets of thick paper on a second uppermost end side, similarly to the case that the sheets of thick paper have permeability.

As illustrated in FIG. 4B, expansion of surfaces of the sheets of thick paper was observed upon vibration, in both cases. This expansion is considered to have resulted from an inflow of air from side surfaces of the media. Thus, it was confirmed that inflow of air occurred from the side surfaces of the media even if the media did not have permeability.

FIGS. 5A to 5C are views for explaining measurement results of friction force of the separating and taking out device according to the first embodiment. Pieces of film-coated paper which did not have permeability and had different thicknesses were used for media, and friction force of the pieces of film-coated paper was measured. The film-coated paper is a typical example of paper from which static electricity is likely to be produced and which is difficult to take out because the friction coefficient is unstable.

FIG. 5A illustrates a measurement position. Measurement was performed by controlling friction force by placing a load on one uppermost end surface of the pieces of film-coated paper (media). FIGS. 5B and 5C illustrate results obtained by measuring inter-media friction force when the respective pieces of film-coated paper have 210 μm and 510 μm. According to the embodiment (data is indicated by "○"), the vibration point was set above the gap 54, and the inter-media friction force decreased. According to a comparative example (data is indicated by "Δ"), a vibration point was set above pieces of film-coated paper, and the inter-media friction force did not decrease sufficiently. Inter-media friction force of a case that vibration was not applied is also shown (data is indicated by "◆").

The position of the ultrasonic vibrator 50 illustrated in FIGS. 2 and 3 i.e. the vibration point of the ultrasonic vibrator 50 is desirably near a center of one of four sides of the media as illustrated in FIGS. 4A and 5A. An experiment was conducted by using sheets of thick paper (media) having sizes of postcards and by changing the planar position of the ultrasonic vibrator 50 at four sides and four corners of the sheets of thick paper. When the planar position of the ultrasonic vibrator 50 was near the center of one side of the four sides, inflow of air became most remarkable and the sheets of thick paper (the media) floated so that the friction force decreased. In consideration that compressed air is produced from a surface of the ultrasonic vibrator 50, it is most desirable from the view point of causing efficient inflow of air between the media to arrange the ultrasonic vibrator 50 in the center of one of the four sides In FIG. 2, the gap 54 between the side surface of the piled stack 10*a* of the media 10 and the contact surface 41 of the support part 40 is desirably narrow. This is because air pressure can decrease and the pressure for lifting one of the media on an uppermost end becomes insufficient when the flow rate of the compressed air produced from the ultrasonic vibrator 50 is fixed and the gap 54 is large. The width of the gap 54 between the side surface of the one of the media 10 on the uppermost end and the contact surface 41 of the support part 40 is desirably 0.5 mm or less and, more preferably, is desirably 0.1 mm or less. In the experiment, the width of the gap between the side surface of the piled stack 10*a* and the contact surface 41 is uneven depending on types of media, and is in a range of 30 to 110 μm. A guide which supports the side surface on an opposite side of the contact surface 41 is desirably installed to keep the gap 54, in order to prevent the media 10 from moving away from the contact surface 41. Alternatively, it is desirable to have a configuration that the piled stack 10*a* is pressed against the contact surface 41 of the support part 40 by inclining an installation angle of the piled stack 10*a* and using the gravitational force.

The measuring unit 60 illustrated in FIG. 1 is a sensor which measures a position of the top surface of the piled stack 10*a* of the media 10, i.e., one of the media 10 on an uppermost end. The measuring unit 60 measures a distance h between the one of the media 10 on the uppermost end and a base surface such as a lower surface of the takeout roller 31, in order to obtain the position of the media. An optical sensor, a contact sensor and a pressure sensor can be used for the measuring unit 60.

In the moving unit 70 illustrated in FIG. 1, the moving base 71 supports the sheet feeding base 20 through the elastic structure 72 in the z axis direction, as described above. The rack 73 and the pinion 74 are provided to move the moving base 71 in the z axis direction. The rack 73 is attached to the moving base 71. The pinion 74 is rotated by a motor (not illustrated). When the pinion 74 rotates in a direction of an arrow T3, the moving base 71 moves in a direction of an arrow T4. Following movement of the moving base 71, the sheet feeding base 20 is moved through the elastic structure 72 in the z direction. Various driving structures can be used instead of the rack 73 and the pinion 74. For example, a mechanism which drives the moving base 71 vertically using a ball screw can be used. Alternatively, a mechanism which drives the moving base 71 upward by a feeding mechanism with a torque limiter can be used.

The control unit 80 illustrated in FIG. 1 is an arithmetic processing unit such as a CPU. The control unit 80 controls rotation of the pinion 74 of the moving unit 70 to align the position of one of the media 10 on an uppermost end in the z axis direction and the position of the top surface 42 of the support part 40 of FIG. 2 in the z axis direction, based on the position of the one of the media 10 on the uppermost end measured by the measuring unit 60.

Further, the control unit 80 controls the operation of the separating and taking out portion 30 i.e. rotations of the takeout roller 31 and the convey roller 32, the operation of the ultrasonic vibrator 50 and the operation of the measuring unit 60.

According to the embodiment, even when media which do not have permeability are used, the separating and taking out device 100 can reduce friction force between the stacked media 10, and can separate and take out the media 10 one by one from the piled stack 10*a* more reliably.

As to the shape of the top surface 42 of the support part 40 of FIG. 2, it is sufficient that at least the portion of the top surface 42 which opposes to the vibration surface 51 is nearly parallel to the top surface of the piled stack 10*a*, and the other portions of the top surface 42 may not be parallel to the top surface of the piled stack 10*a*.

The opposing area $S_1$ of the vibration surface 51 and the top surface of the piled stack 10*a* may be larger than the opposing area $S_2$ of the vibration surface 51 and the top surface 42 of the support part 40. In this case, the amount of air between the vibration surface 51 and the top surface of the piled stack 10*a* increases. Thus, it is possible to produce a traveling wave by vibration of the ultrasonic vibrator 50 efficiently. Further, the center of the vibration surface 51 at which the air pressure is the highest directly below the vibration surface 51 is closer to the top surface of the piled stack 10*a*. Accordingly, the amplitude of the traveling wave produced by vibration of the ultrasonic vibrator 50 increases. As a result, it is possible to spread air which flows along the xy plane in between one of the media 10 on an uppermost end and another one of the media 10 on an second uppermost end, more efficiently. Consequently, when the media 10 are those of high rigidity such as metal films, for example, the embodiment is useful to separate the media 10.

The opposing area $S_1$ of the vibration surface 51 and the top surface of the piled stack 10*a* of the media 10 may be smaller than the opposing area $S_2$ of the vibration surface 51 and the top surface 42 of the support part 40. By reducing the opposing area $S_1$ of the vibration surface 51 and the top surface of the piled stack 10*a*, it is possible to reduce the amplitude of the traveling wave produced by vibration of the ultrasonic vibrator 50. In this case, it is also possible to reduce the friction force produced between the stacked media 10 by vibration, and suppress friction heat produced by the stacked media 10. When the media 10 are plastic films, for example, which are weak against heat, the embodiment is useful to reduce friction force.

When taking out the media 10 from the piled stack 10*a*, the separating and taking out device 100 of FIG. 1 may take out each of the media 10 from an upper end in a direction opposite to the gravitational force direction which is a direction toward a lower surface side of the piled stack 10*a*. Alternatively, the separating and taking out device 100 may take out each of the media 10 from an upper end positioned in the gravitation direction opposite to the direction of the lower surface side of the piled stack 10*a*. Further, the separating and taking out device 100 may take out the media 10 such that the direction toward the side surface side of the piled stack 10*a* is a gravitational force direction and the top and bottom surfaces of the piled stack 10*a* are directed in the horizontal direction.

The separating and taking out device 100 may have two or more ultrasonic vibrators. In this case, it is also possible to provide ultrasonic vibrators with respect to the support part 40, or to arrange two or more support parts so as to provide two or more ultrasonic vibrators 50 with respect to each of the support parts. As the number of ultrasonic vibratos is greater, the amount of air which flows in between the media 10 increases and an effect of levitation of the media 10 on an uppermost end increases so that it is possible to further reduce friction force.

Figure 6:
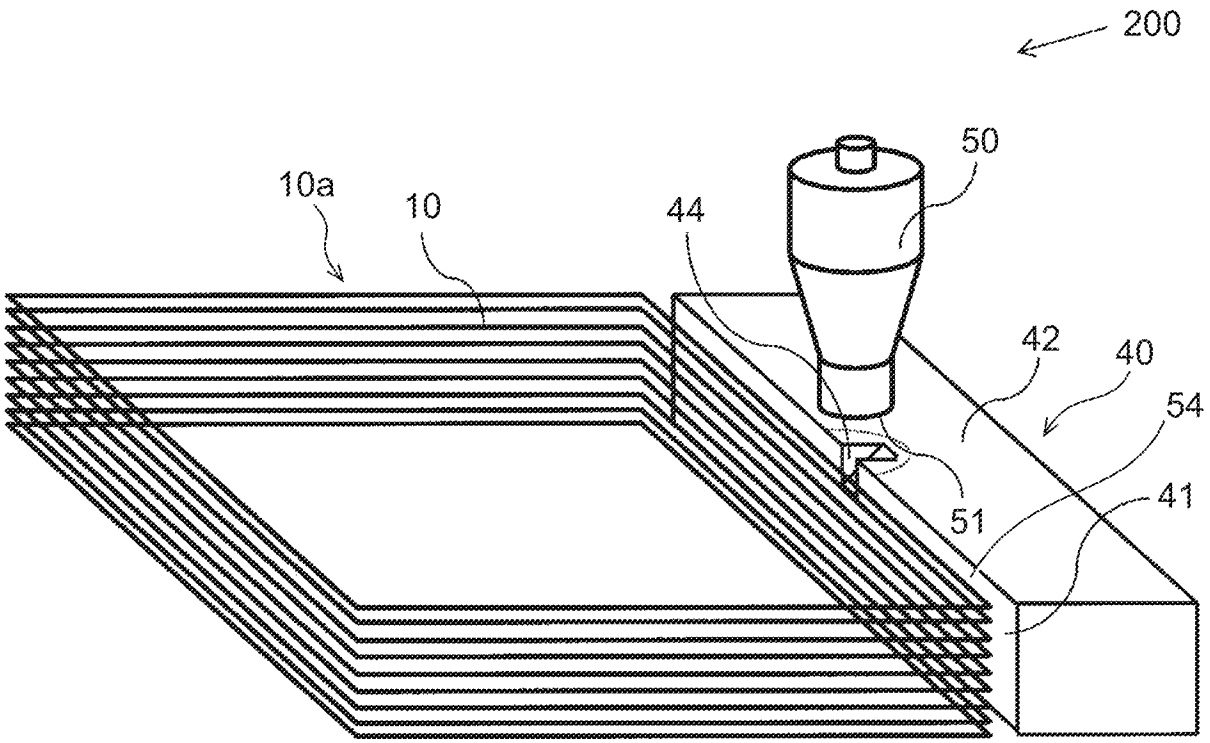
FIG. 6 is a configuration diagram schematically illustrating a main portion of a separating and taking out device according to a second embodiment.

FIG. 6 is a configuration diagram schematically illustrating a main portion of a separating and taking out device according to the second embodiment.

In FIG. 6, a separating and taking out device 200 has a cutout 44 at a position at which a top surface 42 of a support part 40 opposes to a vibration surface 51 of an ultrasonic vibrator 50. The cutout 44 is provided to oppose to a nearly center of the vibration surface 51 of the ultrasonic vibrator 50. This is because the highest acoustic radiation pressure is produced at the center of the ultrasonic vibrator 50. According to this configuration, a ratio of an opposing area $S_2$ of the vibration surface 51 and the top surface 42 of the support part 40 with respect to an opposing area $S_1$ of the vibration surface 51 and a top surface of a piled stack 10*a* of media 10 increases. The opposing areas $S_1$ $S_2$ are obtained by projection in the z axis direction.

FIGS. 7A to 7C are views for explaining measurement results obtained by measuring friction forces of pieces of film-coated paper (media) having different thicknesses. FIG. 7A illustrates vibration points of ultrasonic vibrators according to the second embodiment and a comparative example where the vibration point is set above the media. FIG. 7B illustrates a measurement result obtained by measuring friction force when the cutout 44 is not provided. FIG. 7C illustrates a measurement result obtained by measuring friction force when the cutout 44 is provided. The measurement results shown in FIGS. 7B and 7C include those according to the second embodiment, the comparative example and a case that the ultrasonic vibrator 50 is not oscillated, respectively. The measurement result of the embodiment is indicated by "○". The measurement result of a comparative example is indicated by "Δ". The measurement result of a case that vibration was not applied is indicated by "◆".

The cutout 44 is provided in the second embodiment as illustrated in FIG. 6 and serves to function to supply compressed air to side surfaces of the media 10 through the cutout 44. As a result, it is possible to supply the compressed air deeply in a depth direction irrespectively of the width of a gap 54 between the side surface of the piled stack 10*a* of the media and a contact surface 41 of the support part 40. According to an experiment conducted by the inventors, by providing the cutout 44 which has a depth of 2 mm, the width of 0.3 mm and the length of 1 mm, an effect of reducing friction force between media having thicknesses of about 810 μm was obtained as illustrated in FIG. 7C. As illustrated in FIG. 7C, friction force did not decrease when a cutout is not provided.

The separating and taking out device 200 according to the embodiment can reduce the friction force between thicker media so that the number of types of applicable media increases.

Figure 8:
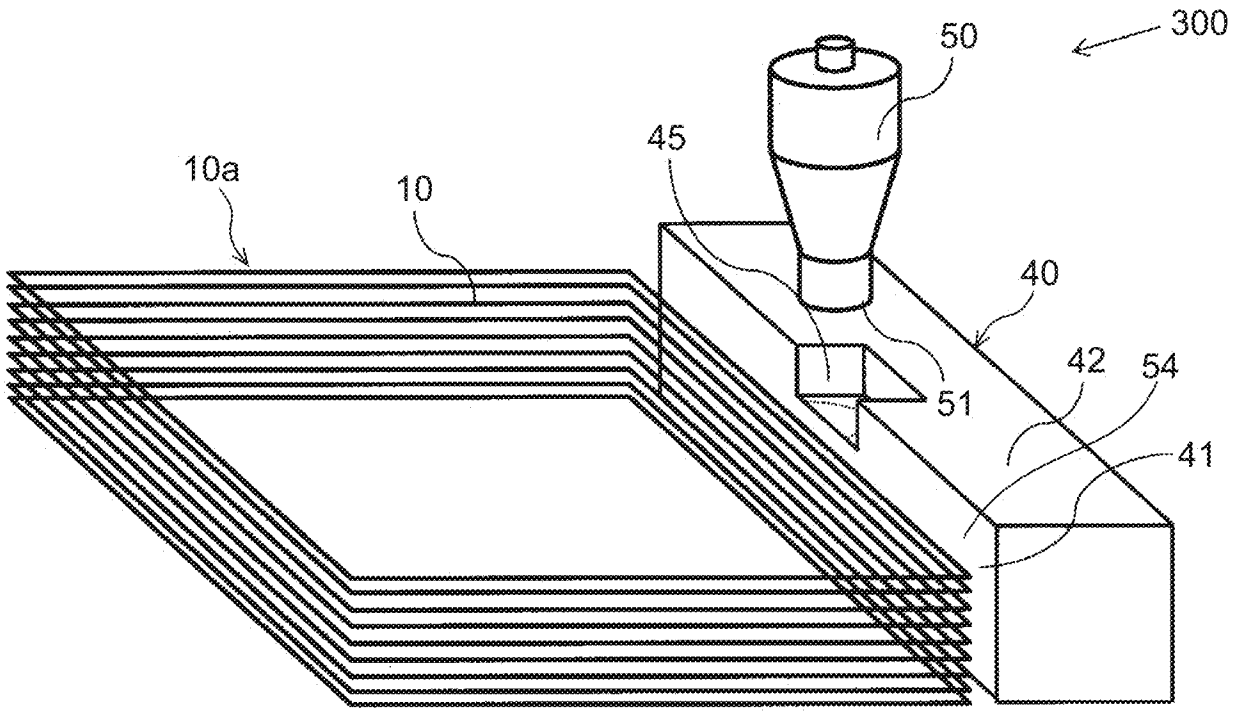
FIG. 8 is a configuration diagram schematically illustrating a main portion of the separating and taking out device according to a third embodiment.

FIG. 8 is a configuration diagram schematically illustrating a main portion of a separating and taking out device according to a third embodiment.

As illustrated in FIG. 8, in a separating and taking out device 300, a concavity 45 is provided at an entire portion of a top surface 42 of a support part 40 which opposes to an ultrasonic vibrator 50. Consequently, it is possible to position an entire vibration surface 51 of the ultrasonic vibrator 50 at a position lower than that of the top surface 42 of the support part 40. According to the embodiment, in a case that media 10 are deformed upward with respect to the vibration surface 51 of the ultrasonic vibrator 50 due to warpage or concavities and convexities of shapes of the media 10, it is possible to support side surfaces of the media 10 in order to prevent the side surfaces of the media 10 from reaching above the top surface 42 of the support part 40 and from being misaligned.

Figure 9:
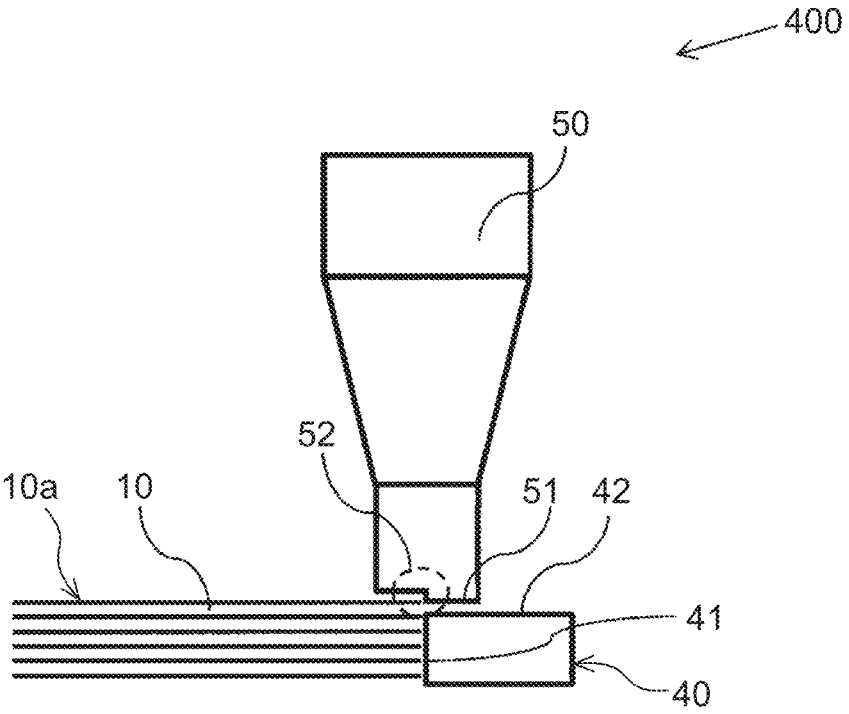
FIG. 9 is a configuration diagram schematically illustrating a main portion of a separating and taking out device according to a fourth embodiment.

FIG. 9 is a configuration diagram schematically illustrating a main portion of a separating and taking out device according to a fourth embodiment.

As illustrated in FIG. 9, in a separating and taking out device 400, a vibration surface 51 of an ultrasonic vibrator 50*a* has a step 52. More specifically, a portion of the vibration surface 51 which opposes a top surface 42 of a support part 40 is lower in the z axis direction i.e. a vertical direction of FIG. 9 than another portion of the vibration surface 51 which opposes the top surface of the piled stack 10*a* of the media 10. The step 52 is provided so that it is possible to set the position where compressed air is produced to a position close to a side surface of a piled stack 10*a* of media 10. Consequently, it is possible to cause an efficient inflow of air from the side surface of the piled stack 10*a*.

The separating and taking out device described above can separate and take out media one by one from a piled stack of the media irrespectively of types of media, more reliably.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A separating and taking out device comprising:

a feeding base to place a piled stack, the piled stack being composed of a plurality of media stacked in a direction;

a taking out part to take out the plurality of media one by one from one end in the direction of the piled stack;

a support part having a facing surface opposing a side surface of the piled stack; and an ultrasonic vibrator having a vibrating surface opposing the one end in the direction of the piled stack and another one end of the support part on a side of the taking out part, the ultrasonic vibrator oscillating the vibrating surface along a line connecting the vibrating surface with a gap between the side surface of the piled stack and the facing surface of the support part.

2. The device according to claim 1, wherein the air permeability of the media is larger than 60 seconds.

3. The device according to claim 1, wherein an opposing area of the vibration surface and the piled stack is equal to or more than an opposing area of the vibration surface and the support part.

4. The device according to claim 1, wherein a distance between one of the media positioned at the one end in the direction and the facing surface of the support part is 0.5 mm or less.

5. The device according to claim 1, further comprising a moving unit which moves the feeding base in the direction, wherein the takeout part is provided for taking out each of the media at an uppermost end, the support part has a top surface at one end of the support part in the direction, and the moving unit moves the feeding base in the direction to align a position of each of the media at an uppermost surface in the direction and a position of the top surface of the support part in the direction.

6. The device according to claim 1, wherein the support part has a top surface at one end of the support part in the direction and has a cutout in a portion of the top surface, and the vibration surface of the ultrasonic vibrator is provided to oppose to the cutout.

7. The device according to claim 1, wherein the ultrasonic vibrator has a step in the vibration surface.

8. The device according to claim 1, wherein the vibration surface is oscillated to produce a traveling wave above an upper surface of one of the media at an uppermost end of the piled stack.

9. The device according to claim 1, wherein the media are paper sheets, and the feeding base is a paper sheet feeding base.

10. A method of separating and taking out by using a separating and taking out device which has a feeding base to place a piled stack which is composed of a plurality of media stacked in a direction and a support part having a facing surface opposing a side surface of the piled stack, comprising:

oscillating a vibration surface of an ultrasonic vibrator so as to supply air compressed by the vibration from the vibration surface along a line which connects the vibration surface with a gap between the side surface of the piled stack and the facing surface of the support part at one end of the piled stack in the direction and taking out the media from the one end in the direction one by one.

* * * * *